United States Patent [19]

Prindle

[11] Patent Number: 4,509,651

[45] Date of Patent: Apr. 9, 1985

[54] VERSATILE KNIFE HOLDER

[75] Inventor: William A. Prindle, Corning, N.Y.

[73] Assignee: Corning Glass Works, Corning, N.Y.

[21] Appl. No.: 512,458

[22] Filed: Jul. 11, 1983

[51] Int. Cl.[3] ..... A47F 7/00

[52] U.S. Cl. ..... 211/70.6; D7/74

[58] Field of Search ..... 211/60 T, 2; 248/37.3, 248/37.6; 30/296 A; 248/188.2, 346, 207; D7/74

[56] References Cited

U.S. PATENT DOCUMENTS

D. 240,496 7/1976 Schultz ..... D7/74

3,452,663 7/1969 Machtig ..... 248/188.2

FOREIGN PATENT DOCUMENTS 451802 5/1968 Switzerland ..... 211/74

OTHER PUBLICATIONS

HFD–Retailing Home Furnishing, 12/29/80, p. 37.

Better Homes and Gardens, Jun., 1978, p. 115.

*Primary Examiner*—Ramon S. Britts

*Assistant Examiner*—Sarah A. Lechok

*Attorney, Agent, or Firm*—B. R. Turner

[57] ABSTRACT

A novel knife holder is set forth having a block-like body portion provided with a plurality of knife blade-receiving slots, and a wedge member is slidably retained on the body member in selected positions by a dovetail spline and grooves for supporting the knife holder in either an upright orientation or an inclined orientation.

11 Claims, 10 Drawing Figures

VERSATILE KNIFE HOLDER

BACKGROUND OF THE INVENTION

Numerous forms of knife holders are known in the art, including magnetic holders and slotted holders. The magnetic type of knife holder generally employs a bar magnet so as to retain a plurality of knife blades in a vertical plane, with the blades positioned in an upwardly-extending orientation. Generally, a support is provided beneath the handle portion of the knives so as to prevent the knives from sliding downwardly off the magnetic bar. Of course, the blades must be made of a magnetic material in order for such knife holder to retain the blades in position.

Various forms of slotted knife holders are also known in the art wherein a plurality of slots, formed in a suitable support, are each adapted to removably receive and retain a knife blade. The slots are customarily formed within a support body so as to receive the knife blades in a generally upwardly-extending position, with a butt end of each handle resting upon a support; or alternately, to receive the knife blades downwardly therein at an inclined angle, such that a forward face of the handle abuts the support body adjacent the slots.

One of the disadvantages encountered with the known knife holders, resides in the fact that the slots for receiving the knife blades are in a fixed orientation with respect to a support base. Thus, for a given knife holder, the slots would either be positioned in a vertical position or an angular position for receiving the knife blades. Since the ordinary housewife is usually pressed for counter space, a vertical orientation of the slots is generally preferred, since such orientation of a support body requires a minimum utilization of counter space. However, in view of the limited vertical distance which exists in many kitches between the counter top and the overlying kitchen cupboards, there may be insufficient room to conveniently remove and replace knives within vertically oriented slots of a knife holder positioned on a counter top beneath a kitchen cupboard. In the alternative, when the slots formed in a knife holder are provided with an angular inclined orientation, the knife holder generally requires more counter top area than would be required of a knife holder having vertically oriented slots. Thus, the housewife is confronted with the dilemma of having to choose between convenience of use, and the utilization of counter top space, when selecting a knife holder for her cutlery.

The present invention overcomes the problems encountered with known knife holders by providing a slotted suppport block which may be operatively positioned with the knife slots in a vertical position or, alternatively, in an inclined angular position. Thus, depending upon the space available and the desired convenience, a housewife may position the cutlery block of the present invention with the knife blade-receiving slots in either a vertical or inclined orientation, by means of a sliding wedge support forming a portion of the support block.

SUMMARY OF THE INVENTION

In its simplest form, the present invention relates to an adjustable versatile cutlery block or knife holder, which may be positioned with a plurality of slots for receiving knife blades, either in an upright vertical orientation, or in an inclined angular orientation. A sliding wedge support, forming a lower corner of the block when the slots are in a vertical orientation, may be repositioned on the block body to complement the surface from which it is removed and form a new support surface therewith, so as to position the slots in an angular inclined orientation.

DESCRIPTION OF THE PREFERRED EMBODIMENTS

Figure 1:
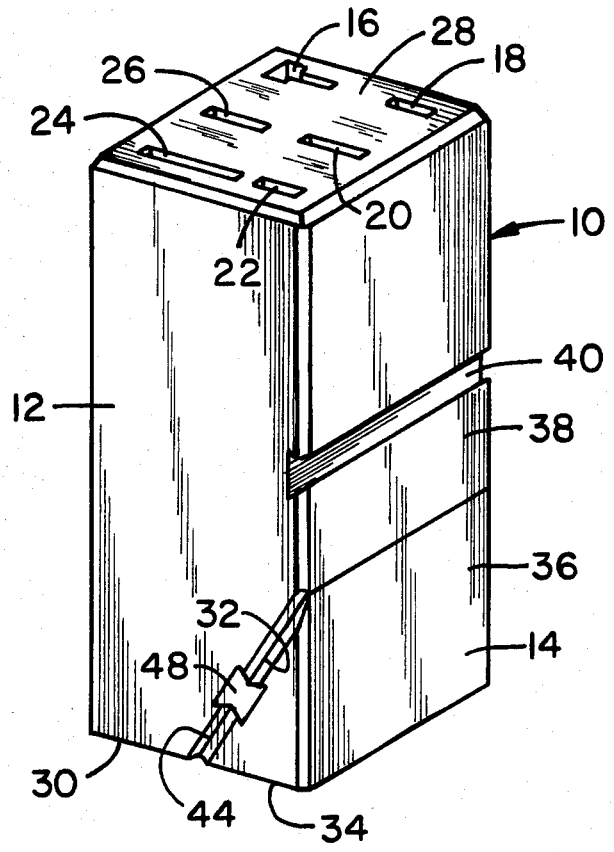
FIG. 1 is a perspective view of the cutlery block of the present invention shown in a vertical upright position.
Figure 2:
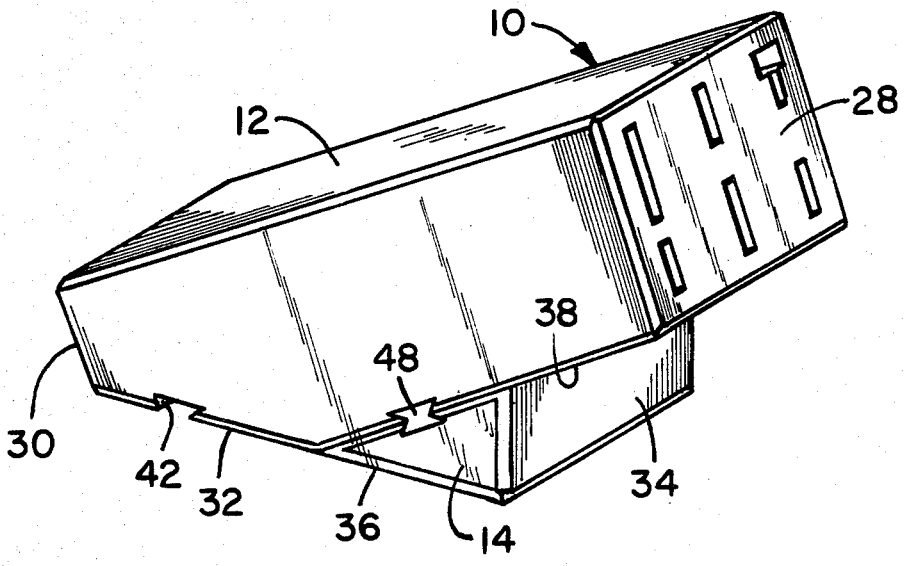
FIG. 2 is a perspective view of the block of FIG. 1 shown in an angular inclined position.
Figure 3:
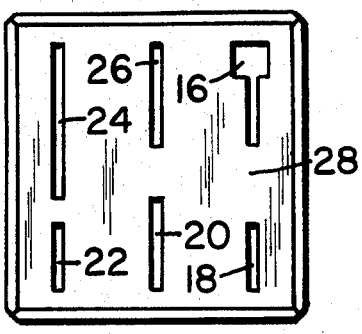
FIG. 3 is a top plan view of the block shown in FIG. 1.
Figure 5:
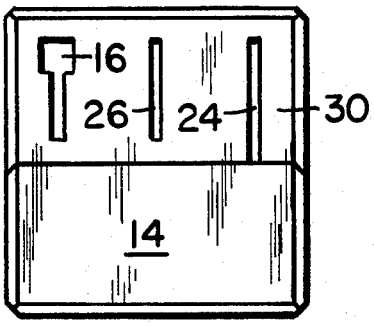
FIG. 5 is a bottom plan view of the block shown in FIG. 1.

Referring now to the drawings, a support block 10 is shown comprising a block body 12 and a sliding wedge support 14, both of which may be provided with beveled edges, as shown. The sliding wedge support 14, in one position, complements the block body 12 to form a vertical upright cutlery block 10 having the form of a rectangular prism as shown in FIG. 1, and in another position, complements block body 12 to provide an extended support surface for retaining the cutlery block 10 in an inclined orientation as shown in FIG. 2.

The block body 12 is provided with a plurality of slots, such as 16, 18, 20, 22, 24, and 26, which extend longitudinally therethrough. Although six slots are shown in the drawings, the number and shape of the slots utilized may vary as desired. Slot 16 is shown having a T-shape, so as to accommodate either a knife-sharpening rod or a knife blade. Although the support block may be fabricated from any suitable material such as wood, plastic, or ceramic, when the block is formed of wood as I prefer, slots 16–26 may be saw-cut into opposed sides of an initial block, and opposed veneer sides may be laminated to the initial block to close the edges of the slots and form composite block body 12.

Figure 7:
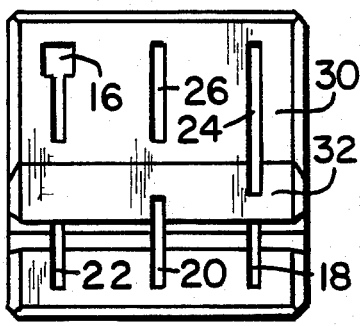
FIG. 7 is a bottom plan view of the block shown in FIG. 1, but with the sliding wedge support removed.
Figure 4:
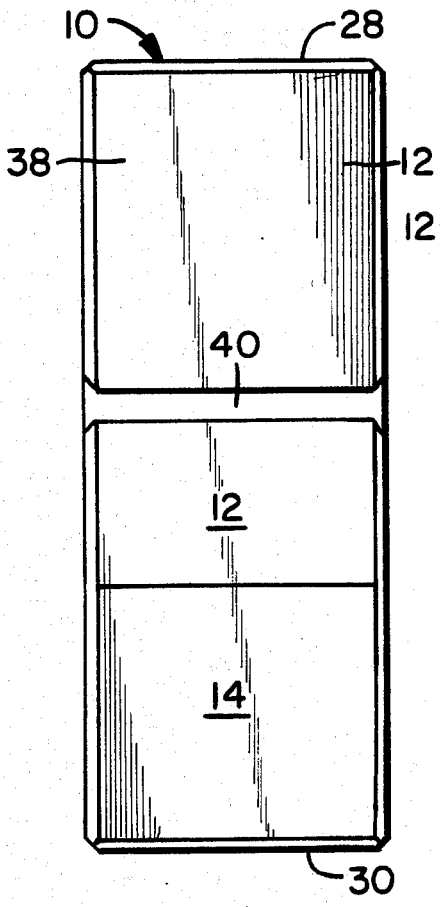
FIG. 4 is a rear elevational view of the block shown in FIG. 1.
Figure 6:
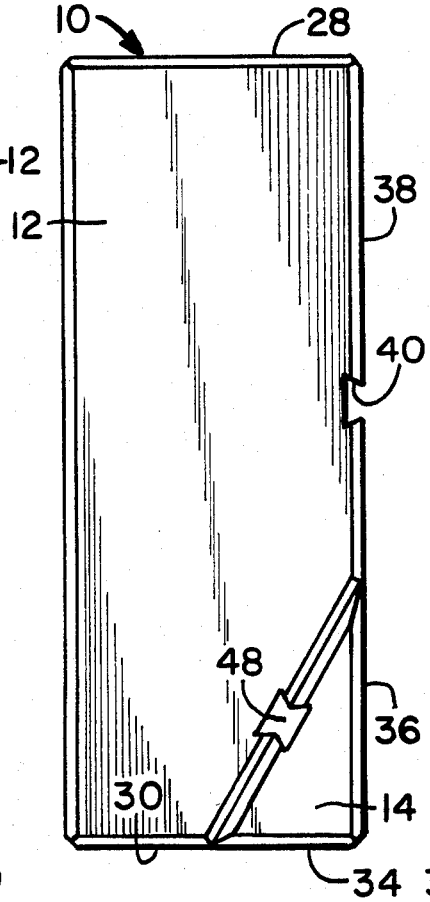
FIG. 6 is a side elevational view of the block shown in FIG. 1.
Figure 8:
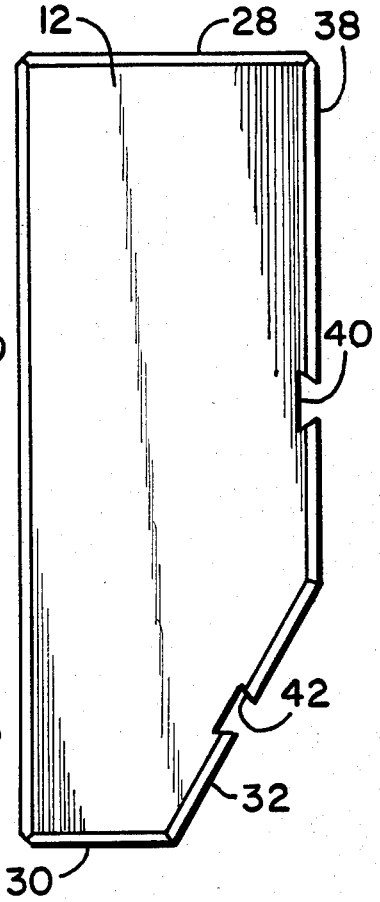
FIG. 8 is a side elevational view of the block shown in FIG. 1, but with the sliding wedge support removed.
Figure 9:
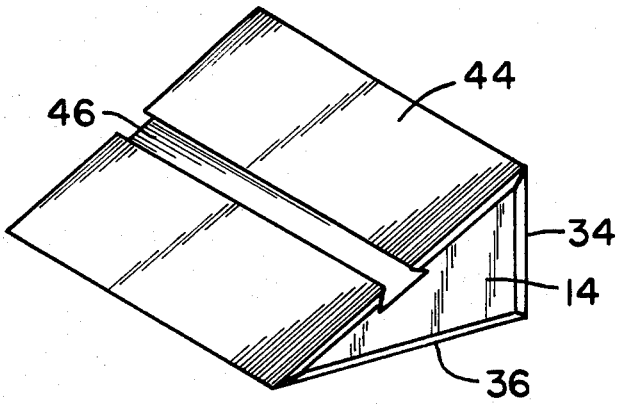
FIG. 9 is a perspective view of the sliding wedge support.

The block body 12 has an upper inlet surface 28, a lower support surface 30, utilized in supporting the block in an upright position, and a lower support surface 32, utilized for supporting the block in an inclined position. As shown particularly in FIG. 7, the slots 16–26 communicate with the lower support surfaces 30 and 32. The wedge support 14 also has two support surfaces including support surface 34, which complements lower support surface 30 when the block 10 is in an upright vertical position, and support surface 36, which complements lower support surface 32 when the block 10 is an inclined angular position.

Figure 10:
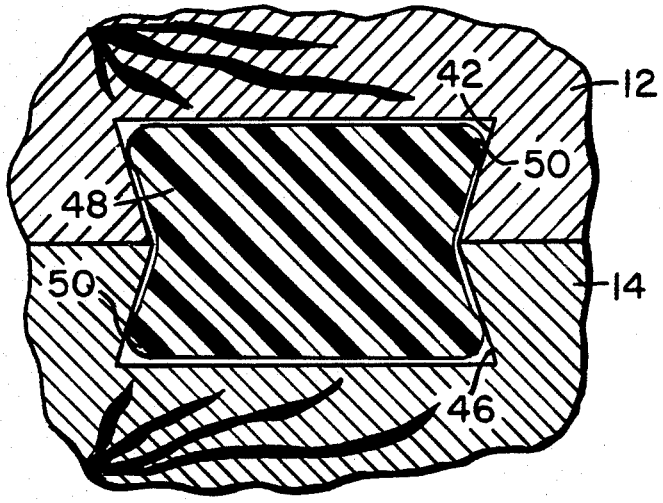
FIG. 10 is an enlarged fragmental cross-sectional view of the dovetail spline assembly connecting the sliding wedge support to the block body.

The block body 12 has a rear surface 38 provided with a dovetail groove 40, and an identical dovetail groove 42 is formed in lower support surface 32. In a like manner, wedge support 14 has a slant surface 44 provided with a dovetail groove 46. As shown in FIG. 10, a dovetail spline 48, which may be made of any suitable material such as plastic, is frictionally received within dovetail slots 40 or 42 and 46 to slidably retain the sliding wedge support 14 in desired orientation on block body 12. The dovetail spline may be provided with a plurality of expanded portions 50 which form an interference fit with wall portions of the dovetail grooves 40, 42, 46, and for convenience, the spline may be fixed in the wedge support groove 46, such as by adhesive or stapling.

As shown in FIG. 1, when the slant surface 44 of sliding wedge support 14 is juxtapositioned lower support surface 32 of block body 12, support surface 34 of wedge support 14 complements lower support surface 30 of the block body 12, so as to support the cutlery block 10 in a vertical upright position. On the other hand, when the slant surface 44 of wedge support 14 is juxtapositioned the rear surface 38 of block body 12, as shown in FIG. 2, the support surface 36 of wedge support 14 complements lower support surface 32 of block body 12 so as to support the cutlery block 10 in an inclined angular position.

In operation, with the cutlery block 10 in the upright position as shown in FIG. 1, a plurality of knives may be positioned with their blades inserted downwardly within slots 16–26, such that a forward portion of each knife handle abuts against upper inlet surface 28 to limit the downward position of the knife within each slot. The rear surface 38 would normally be positioned away from the observer, and the knives retained by the cutlery support block would be stored in a vertical position, requiring only minimal counter space, and if desired such knives could be removed therefrom and replaced therein in a purely vertical fashion. However, should it be more convenient for access to remove and replace the knives at an inclined angle, the sliding wedge support 14 and dovetail spline 48 are slidably removed from dovetail groove 42, the wedge support 14 is rotated 180°, and dovetail spline 48 is frictionally slid into dovetail groove 40 to slidably position slant surface 44 of wedge support 14 in juxtaposition with rear surface 38. Thus, the cutlery block 10 is supported on complementary support surfaces 32, 36 at an inclined angular position, so that the knives retained in slots 16–26 may be easily removed from and returned to the support block in an inclined fashion.

Although I have now set forth the preferred embodiments of my invention, it will be apparent to those skilled in the art that various changes and modifications may be made thereto without departing from the spirit and scope of the invention as set forth in the appended claims.

I claim:

1. A cutlery holder for positionably retaining a plurality of cutlery items in either an upright orientation or in an inclined orientation, which comprises, a body portion having a plurality of slots formed therein for receiving blade portions of cutlery items, selectively positionable wedge means forming a complementary portion of said body portion, and means for removably retaining said wedge means in alternate positions on said body portion and for positioning said cutlery holder in either a stable upright orientation or an inclined orientation, as desired.

2. A cutlery holder as defined in claim 1, wherein said wedge means complements said body portion when the holder is in an upright orientation to form a cutlery holder having the configuration of a rectangular prism, with said wedge means forming a portion of said rectangular prism.

3. A cutlery holder as defined in claim 1, wherein said means for removably retaining said wedge means on said body portion includes a pair of dovetail grooves formed in selected surfaces of said body portion, a dovetail groove formed in said wedge means, and a dovetail spline cooperable with said dovetail grooves for slidably retaining said wedge means on said body portion adjacent said selected surfaces.

4. A cutlery holder as defined in claim 1, wherein said body portion has a first lower support surface and second lower support surface, said wedge means having a first support surface and a second support surface, said first support surface of said wedge means complementing said first lower support surface of said body portion for supporting said cutlery holder in an upright orientation when said wedge means is retained in a first position on said body portion, and said second support surface of said wedge means complementing said second lower support surface of said body portion for supporting said cutlery holder in an inclined orientation when said wedge means is retained on said body portion in a second position.

5. A cutlery holder as defined in claim 1, wherein said wedge means includes a slant surface, a first support surface, and a second support surface; said means for removably retaining said wedge means on said body portion including a first and second dovetail groove formed in selected surfaces of said body portion and a dovetail groove formed in said slant surface, and a slidable dovetail spline cooperably engaging said grooves for slidably retaining said wedge means on said body portion with said slant surface juxtapositioned said selected surfaces; and said first support surface providing support to retain said cutlery holder in an upright orientation when said wedge means is retained by said first dovetail groove, and said second support surface providing support to retain said cutlery holder in an inclined orientation when said wedge means is retained by said second dovetail groove.

6. A holder for cutlery items which may be positioned in eigher an upright orientation or an inclined orientation which comprises, a body member having a plurality of slots formed therein for receiving blade portions of cutlery items, a wedge shaped member removably secured to said body member, and means for slidably retaining said wedge shaped member on said body member in a first position for supporting said holder in an upright orientation and in a second position for supporting said holder in an inclined orientation, and said wedge shaped member complementing said body member to form a block-like holder having the configuration of a retangular prism, when retained on said body member in said first position.

7. A holder for cutlery items as defined in claim 6, wherein said body member has a first lower support surface and a second lower support surface, said wedge shaped member having a first support surface and a second support surface, and said first support surface of said wedge shaped member complementing said first lower support surface of said body member to support said holder in an upright orientation when said wedge shaped member is retained in said first position on said body member, and said second support surface of said wedge shaped member complementing said second lower support surface of said body member to support said holder in an inclined orientation when said wedge shaped member is retained in said second position on said body member.

8. A holder for cutlery items as defined in claim 6, wherein said wedge shaped member has a slant surface and said body member has a lower support surface and a rear surface, and said means for retaining said wedge shaped member on said body member juxtapositioning said slant surface and said lower support surface when said wedge shaped member is retained in said first position on said body member, and juxtapositioning said slant surface and said rear surface when said wedge shaped member is retained in said second position on said body member.

9. A block-like knife holder positionable in either an upright orientation or an inclined orientation which comprises, a body member having a plurality of slots formed longitudinally therewithin for removably retaining a plurality of knife blades positioned downwardly within such slots, a wedge shaped support member removably secured to said body member and having a first and second support surface, means for removably positioning said support member in selected locations on said body member for supporting said block-like knife holder in either an upright orientation or an inclined orientation, said first support surface cooperating with an adjacent surface on said body member for supporting said block-like knife holder in an upright orientation with said wedge shaped support member forming a part of and complementing the block-like configuration of said knife holder when said knife holder is positioned in an upright orientation, and said second support surface cooperating with an adjacent surface on said body member for supporting said block-like knife holder in an inclined orientation.

10. A block-like knife holder as defined in claim 7, wherein said body member has a lower support surface adjacent a rear surface, said support member has a slant surface; said means for removably positioning said support member on said body member including a dovetail groove formed in the lower support surface of said body member, the rear surface of said body member and the slant surface of said support member; and a dovetail spline cooperable with said dovetail grooves for slidably retaining said support member on said body member with the slant surface engaging said lower support surface when said knife holder is supported in an upright orientation, and engaging said rear surface when said knife holder is supported in an inclined orientation.

11. A block-like knife holder as defined in claim 9, wherein said means for removably positioning said support member on said body member includes a plurality of dovetail grooves formed on said body member, a dovetail groove formed on said support member and a dovetail spline slidably positionable within said dovetail grooves, and means for frictionably retaining said spline within said grooves.

* * * * *